US007024973B2

(12) United States Patent
Kobert et al.

(10) Patent No.: US 7,024,973 B2
(45) **Date of Patent: *Apr. 11, 2006**

(54) OXYGEN SENSOR REMOVAL AND INSTALLATION TOOL

(75) Inventors: Jon A. Kobert, Julesburg, CO (US); Michael L. Whitehead, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/917,138

(22) Filed: Aug. 12, 2004

(65) Prior Publication Data

US 2005/0066780 A1 Mar. 31, 2005

Related U.S. Application Data

(60) Provisional application No. 60/494,694, filed on Aug. 13, 2003.

(51) Int. Cl.
*B25B 21/02* (2006.01)

(52) U.S. Cl. ..... 81/463; 81/124.7

(58) Field of Classification Search ..... 81/124.2, 81/124.7, 463

See application file for complete search history.

(56) References Cited

U.S. PATENT DOCUMENTS

| | | | | |
|---|---|---|---|---|
| 5,161,440 | A * | 11/1992 | Jordan | 81/463 |
| H001689 | H * | 11/1997 | Foucher | 81/124.3 |
| 6,354,178 | B1 * | 3/2002 | Pool et al. | 81/463 |
| 6,725,747 | B1 * | 4/2004 | Erwin | 81/124.2 |
| 6,748,833 | B1 * | 6/2004 | Williams | 81/465 |
| 6,769,334 | B1 * | 8/2004 | Whitehead et al. | 81/463 |

OTHER PUBLICATIONS

Lisle Catalog, p. 18, Part No. 12100, "Oxygen Sensor Socket".

Lisle Catalog, p. 5, Part No. 43220, "Right Angle Impact Wrench".

Owatonna Tool Co., etoolcart.com, Part No. OTC7807, "Heated Oxygen Sensor Wrench", May 26, 2004.

Schley Products, etoolcart.com, Part No. SP88750, "Offset Oxygen Sensor", May 26, 2004.

Schley Products, etoolcart.com, Part No. SP93750, "Oxygen Sensor Wrench".

* cited by examiner

*Primary Examiner*—David B. Thomas
(74) *Attorney, Agent, or Firm*—Banner & Witcoff Ltd.

(57) ABSTRACT

An oxygen sensor removal and installation tool comprises a driving wrench which includes a socket drive with a socket sized to fit onto an oxygen sensor of a vehicle. The driving wrench is made from a thin plate of steel with an attached socket drive projecting at a right angle from the plane of the flat plate. A separate handle includes bifurcated legs which fit over the sides of the opposite end of the flat plate driving wrench and engage a driving surface to vibrate and drive the driving wrench and impart a turning force on the oxygen sensor.

7 Claims, 3 Drawing Sheets

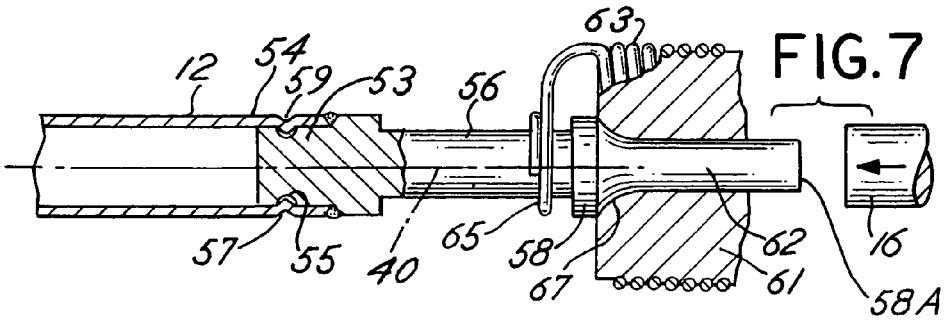
FIG.7
FIG.8
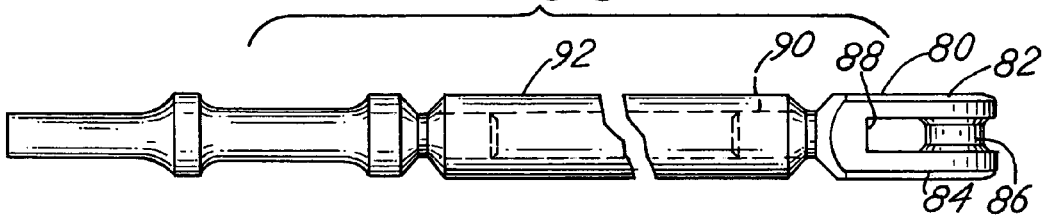
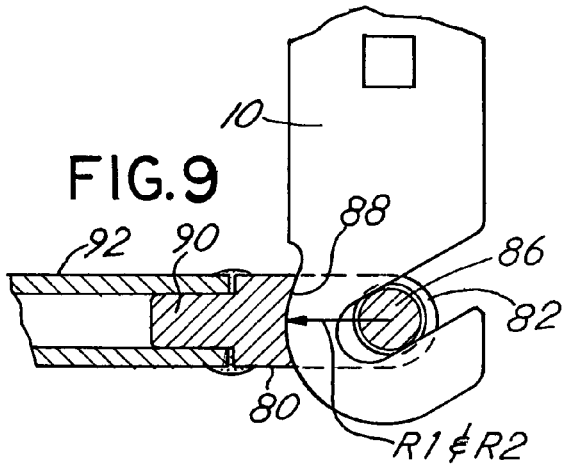
FIG.9
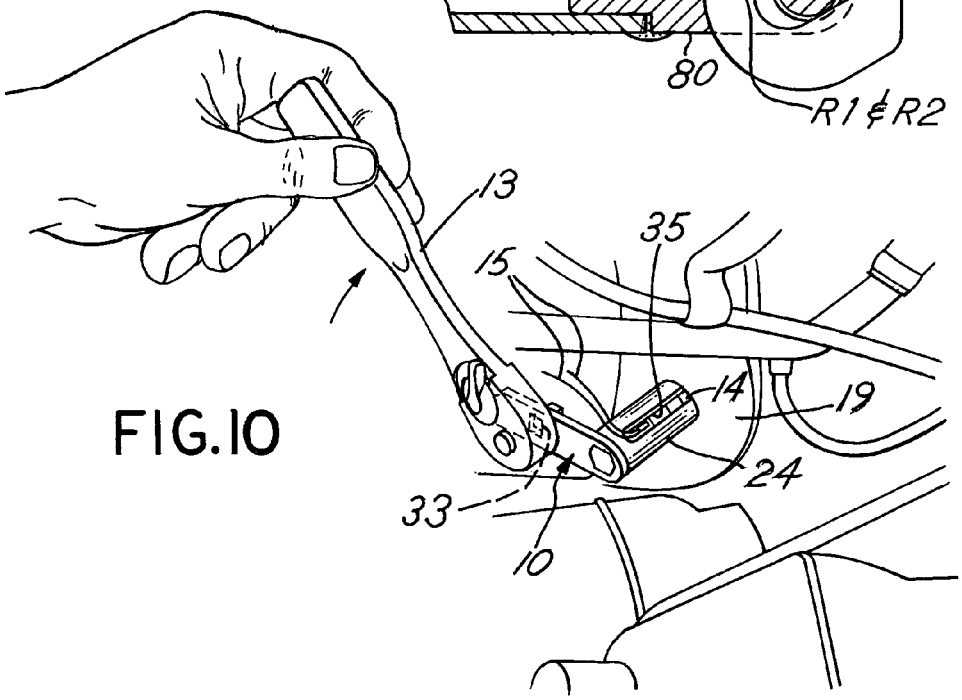
FIG.10

OXYGEN SENSOR REMOVAL AND INSTALLATION TOOL

CROSS REFERENCE TO RELATED APPLICATION

This application is a utility application based on Ser. No. 60/494,694 entitled "Oxygen Sensor Removal Tool" filed Aug. 13, 2003 for which priority is claimed.

BACKGROUND OF THE INVENTION

In a principal aspect the present invention relates to an automotive or vehicle repair tool, and, more particularly, to a wrench tool which is useful for the removal and replacement of an oxygen sensor associated with an internal combustion engine. Removal is effected by engaging the sensor retention nut and effecting release of the nut from its mounting by application of vibration and torque. Replacement is effected by using the same tool. The present invention comprises an improvement to a tool of a type generally disclosed in U.S. Pat. No. 6,354,178 B2 which is incorporated herewith by reference.

The oxygen sensor for an internal combustion engine typically has at least in part a polygonal housing outer surface as well as two lead wires leading into the housing from a connector. The wires may be connected via the connector to the vehicle sensing and control circuitry after the sensor is threaded into the appropriate part of a vehicle engine. When repairing or servicing a vehicle by removal and replacement of the oxygen sensor, the wires are generally cut and the sensor is unthreaded from the engine to remove the sensor. This is followed by subsequent replacement of the oxygen sensor with a new sensor.

Because such sensors may be corroded, they are often difficult to remove. Merely unthreading such a sensor from its part or mount in a vehicle engine compartment may thus be difficult. Release of a corroded sensor may therefore necessitate vibration forces as well as turning forces. Thus, there has developed a need to provide an automotive service tool which may be effective for removal of an oxygen sensor from a vehicle engine compartment. Preferably, such a tool should be useful for replacement of a new sensor.

SUMMARY OF THE INVENTION

Briefly, the present invention comprises an automotive tool which includes two principal component parts: (1) a sensor engaging and driving wrench to engage an oxygen sensor; and (2) a drive handle for engaging the driving wrench to effect removal of the oxygen sensor. Further, the driving wrench is constructed to enable its use in combination with a socket drive for installation of a new oxygen sensor. Also, the tool(s) may be used to remove and replace other components associated with engines and other devices wherein the components have features, characteristics or a construction similar to that of an oxygen sensor.

The sensor engaging driving wrench includes a slotted socket which may be placed over an oxygen sensor housing. The driving wrench is further comprised of a flat steel plate having the slotted socket welded on one end thereof projecting at a right angle or laterally therefrom. The flat plate is relatively short, in the range of 2–7 inches, and includes an open end slot at the opposite end from the slotted socket. An arcuate, outside driving surface is provided positioned at the open slotted end of the flat plate for cooperation with the drive handle. The flat plate further includes a socket drive opening for cooperation with a socket drive when replacing a sensor. Though the plate is preferably flat, other configurations are useful.

The drive handle is designed to engage against the arcuate outside driving surface of the driving wrench. The drive handle includes a yoke comprised of a pair of arms which are spaced one from the other so that they fit over the opposite sides of the flat plate of the driving wrench. A pin connecting the spaced arms is fitted into the open slot at the end of the driving wrench to facilitate retention of the driving wrench engaged in position with the drive handle when the tool is being used.

In use, the drive handle may be engaged against the drive surface of the driving wrench and a pneumatic tool or other driving device may be impacted against the drive handle to drive the driving wrench slotted socket placed on the sensor and thus, by means of rotation and vibration, release the oxygen sensor to thereby effect its removal. Replacement of the sensor is effected by placing the drive wrench slotted end socket onto the new sensor with the wires of the sensor fitted through the slot in the slotted socket. The driving wrench may then by rotated about the center line axis of the slotted socket and tightening of the sensor effected by a socket drive engaged with the drive wrench.

Thus, it is an object of the invention to provide a tool or tool kit useful for removal and/or replacement of an engine oxygen sensor.

Another object of the invention is to provide a tool or tool kit which is rugged, inexpensive and easy to use for removal and/or replacement of an oxygen sensor and other similar components.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 7 is a partial plan view of the handle of FIG. 5 in combination with a pneumatic driver;

FIG. 8 is a partial cross sectional view of an alternative driving end of a drive handle wherein the driving end is comprised of an investment cast member;

FIG. 9 is a partial cross sectional view of the drive handle end of FIG. 8 and an oxygen socket drive wrench cooperative with the driving end of the drive handle; and FIG. 10 is an isometric view of an oxygen sensor drive wrench in combination with a socket drive for installation of an oxygen sensor.

DESCRIPTION OF THE PREFERRED EMBODIMENT

Figure 1:
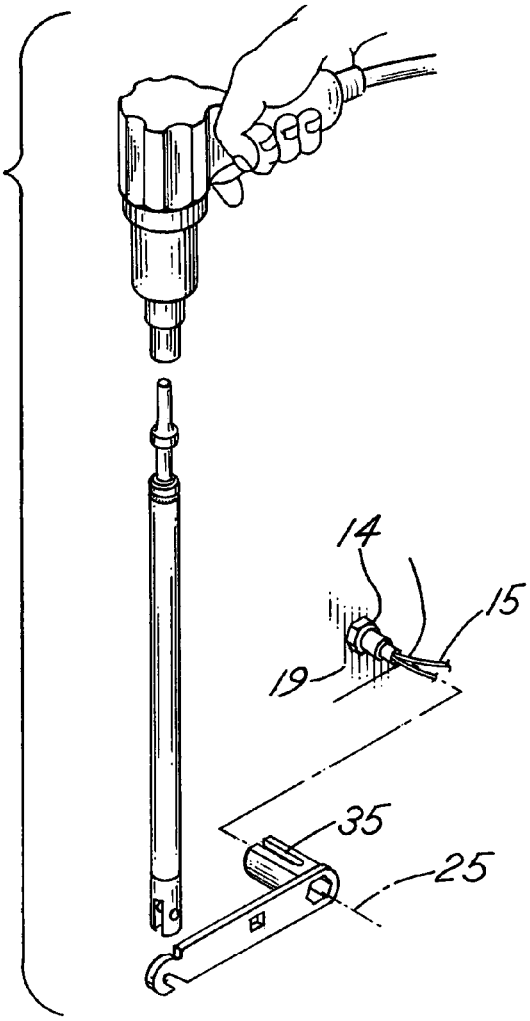
FIG. 1 is an exploded isometric view of the wrench combination as it is utilized for removing or installing an oxygen sensor.
Figure 2:
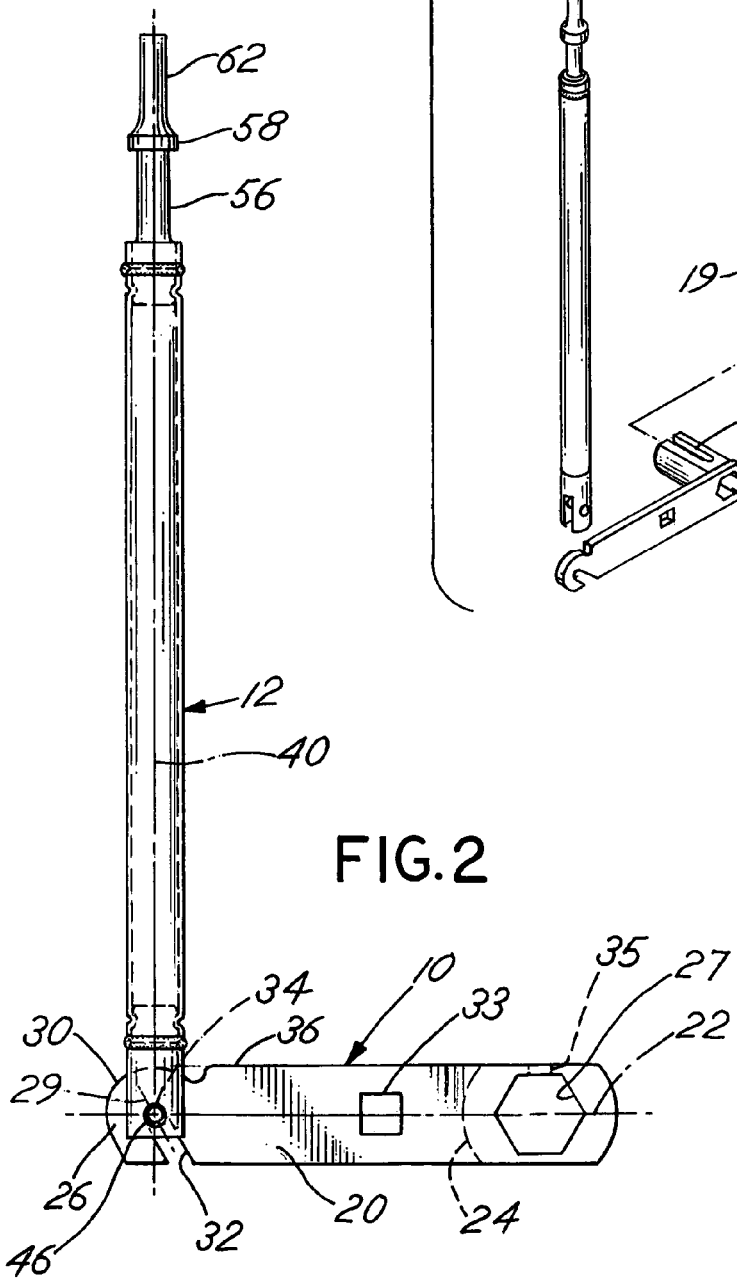
FIG. 2 is a plan view of the combination of FIG. 1.

Referring to the figures, the tool comprises multiple elements or components which may be in the form of a kit and which includes a sensor drive wrench part or element 10 and a separate drive handle part or element 12. A socket drive 13, as in FIG. 10, may also be included. The driving or drive wrench component or driving wrench 10 and drive handle 12 are used in combination to remove an oxygen sensor 14, as depicted in FIG. 1, by engaging the sensor 14 and turning the sensor 14 in response to vibration and turning forces imparted thereto through the wrench 10 and handle 12. The forces are provided, for example, by a pneumatic tool 16 or a hammer which engages against one end of handle 12. The drive wrench 10 may also be used in combination with a socket drive 13, as described hereinafter with reference to FIG. 10, for installation of a sensor 14.

The driving wrench 10 includes a flat plate or lever arm 20 with a longitudinal or lever arm axis 22 extending the length of the lever arm 20. Lever arm 20 is typically 2 inches to 7 inches long in the direction of the longitudinal axis 22. The driving wrench 10 is made from a flat planar steel plate material and further includes a slotted socket 24 at one end 21 and a driving or impact opposite end 26. The socket 24 is configured and sized to be compatible with and appropriately engage the polygonal outside surface of a sensor 14.

The lever arm 20 of wrench 10 further includes a polygonal throughbore 33 intermediate the opposite ends for receipt of a socket drive when the wrench is used to install a sensor. The bore 33 is spaced from the turning or rotational axis of socket 24 to provide a mechanical advantage.

Figure 3:
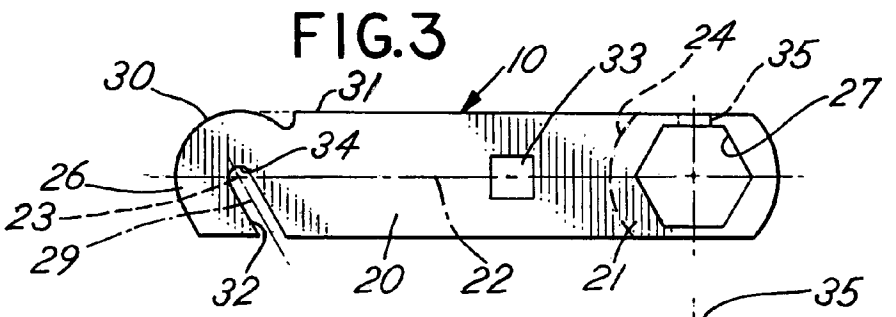
FIG. 3 is a plan view of the drive wrench element of the combination.
Figure 4:
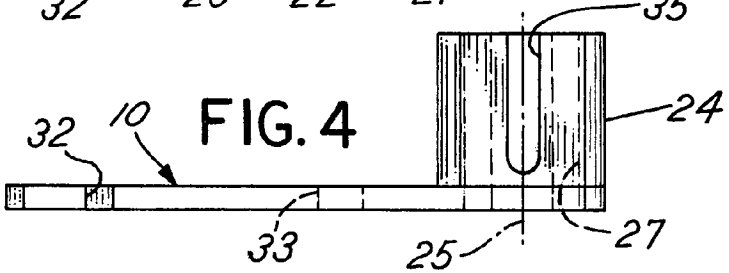
FIG. 4 is a side elevation of the drive wrench of FIG. 3.

The impact or driving end 26 of the driving wrench 10 includes an arcuate surface 30 which is defined along a top edge 36 of the plate 20 comprising the driving wrench 10. The arcuate surface 30 extends along an arc in the range of at least 5° up to about 245°. Preferably, the arcuate range is at least 15° and, in a most preferred embodiment, the range extends to as much as about 245° of arc and is at least 40° of arc in extent. The arcuate surface 30 is preferably circular in configuration and is centered on center 23 on the axis 22 as depicted in FIG. 3. Center 27 may also be offset from axis 22.

A longitudinal slot 32 having a uniform width extends upwardly in the impact end 26 toward the arcuate surface 30 from the side opposite the arcuate surface 30. The longitudinal slot 32 terminates with a curved surface 34, which is preferably a circular arc, and which may be concentric with the center of the arcuate surface 30. The sides of the slot 32 form an angle with the axis 22 in the range of 20° to 120°. Preferably, the sides of uniform width slot 32 are inclined toward the socket 24 and form an angle of approximately 60° with the axis 22.

The slotted socket 24 is welded to the flat plate 10 and extends at a right angle or transversely therefrom thereby defining an axis 25 perpendicular to the axis 22 of the plate 10. The socket 24 includes a hexagonal end passage or counterbore which is adapted to fit over the outside compatible polygonal surface of the sensor 14. Socket 24 may be formed from tubing which is broached at one end to form a polygonal socket shape. Socket 24 further includes a longitudinal, axial slot 35 which is preferably parallel to axis 25 and extends through the outside end of the socket 24.

Figure 5:
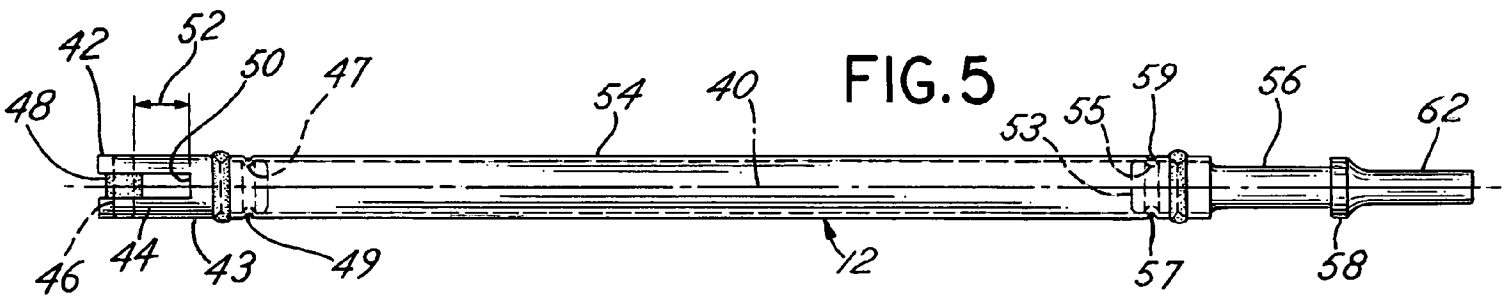
FIG. 5 is a plan view of the drive handle.
Figure 6:
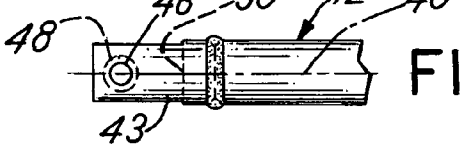
FIG. 6 is a partial plan view of the drive handle of FIG. 5 rotated by 90°.

The drive handle 12 includes a longitudinal axis 40. At one end of the drive handle 12 are parallel, spaced axially extending arms 42 and 44 defining a yoke member 43. The arms 42, 44 are connected by a transverse pin 46 which includes an elastic bushing or outside face 48. For example, bushing 48 may comprise a ⅛ inch layer of polyurethane over a ¼ inch diameter pin. Pin 46 is transverse to the axis 40. Arms 42 and 44 are spaced from one another slightly greater than the width or thickness of the driving wrench plate 10 so that the arms 42, 44 can easily fit over the plate comprising the wrench 10 and so that the pin 46, with its elastic bushing 48, can slide into the slot 32 of drive wrench 10. The pin 46 is spaced from an upper impact surface 50 defined between the arms 42 and 44 at the top end of the slot defined by those arms 42, 44 at a distance slightly greater than the maximum dimension of the width or distance between the top of the slot 32 and the arcuate surface 30; namely, the dimension exemplified by the distance 52 in FIG. 5. Thus, the pin 46 may easily slide into slot 32 with some space or play available between the surface 50 and the surface 30. The drive handle 12 is typically formed from a steel tube. The arms 42 and 44 may be separately formed on a rod fitted into one end of tube 54.

As depicted in FIG. 7, a ram head or driver head 56 in the form of a rod 62, is positioned and engaged with the tube 54 at the upper end of the handle 12. The head 56 includes a flange 58 so that a pneumatic drive collet 61 of pneumatic hammer 16 may be fitted over the rod 62 and engage against the rod end 58A to impart force thereto. A coil spring 63 threads onto the end of impact tool 16. The free end of the spring 63 is formed as a loop 65 which fits around the head 56 and retains the handle 12 adjacent to a radiused area 67 on the front of the tool 16. The spring 63 keeps the driver handle 12 from falling out of the impact tool 16 and also is a safety device to prevent launching the handle 12 away from the tool 16.

Tube 54 is a hollow member sized to receive a generally cylindrical end 53 of head 56. A circumferential groove 55 in end 53 receives staked sections 57, 59 of tube 54 to retain head 56 connected to tube 54. Similarly, yoke member 43 includes a circumferential groove 47 cooperative with staked sections 49 of tube 54. Because grooves 47, 55 are circumferential, the yoke member 43 or head 56 may be rotated to facilitate use of the tool.

FIGS. 8 and 9 depict an alternative embodiment of a drive handle 12, and more particularly, the addition of a yoke 80 as depicted in FIGS. 8 and 9 for use with a drive wrench 10, for example, as shown in FIG. 9. Specifically, the yoke 80 is formed by investment casting methods so that a unitary yoke 80 comprises first and second parallel spaced arms 82 and 84 connected by an integral generally cylindrical shaped pin 86 which is spaced from an arcuate engagement surface 88. It is to be noted that the radius of curvature, R1, of the arcuate engagement surface formed by the investment casting method is substantially identical to the radius of curvature R2 of the driving wrench 10. It has been discovered that by matching the radius of curvature of these elements, that a more consistent and continuous driving force may be applied to a nut, for example. The yoke 80 further includes a projecting axial stub or stud 90 which fits within a hollow cylindrical steel tube 92 and may effect alignment of the yoke 80 therewith. The yoke 80 and the tube 92 may be attached one to the other by means of laser welding for example. Laser welding techniques seem to be especially beneficial to the manufacture of such a drive handle.

In practice, socket 24 is placed over the oxygen sensor 14. Lead wires 15 associated with the sensor 14 may be cut from the sensor inasmuch as the sensor 14 is being replaced and the lead wires 15 need not be preserved. In the construction of the invention the plate 10 may be appropriately inserted within an engine compartment in a manner which will facilitate placement of the socket 24 on the sensor 14 without interference with portions of the engine of a vehicle or attachments thereto. A pneumatic wrench or impact tool 16 may then be used to provide torque as well as vibration to effectively loosen the sensor 14 from its mounting plate 19. In this manner, the sensor 14 may then be easily removed and any corrosion, rusting or the like, which would otherwise tend to maintain the sensor locked in position on its mounting plate 19, is overcome. Of course, the direction and orientation of the tool and its rotational movement about the axis 25 may be varied by virtue of the direction in which the tool is aligned on the sensor 14.

To replace a sensor, the wires 15 would be fed through the lateral or side slot 31 as the sensor is gripped by socket 24. A socket drive may then engage bore 33 to tighten the sensor in place.

Sockets of various sizes may also be used or incorporated to accommodate oxygen sensors of various polygonal external configuration and size. Thus, while there has been set forth a preferred embodiment of the invention, it is to be understood that the invention is limited only by the following claims and equivalents.

What is claimed is:

1. An oxygen sensor removal and installation tool kit comprising, in combination:

(a) a socket wrench including a generally flat plate with a socket drive end and an impact end with a slot opening in the plate of the impact end, a socket at the socket drive end oriented generally transverse to the plane of the flat plate; and (b) a drive handle having a longitudinal axis with a first end for receiving a ram and vibration source, and a second end for engaging the impact end of the socket wrench, said handle including a pin for cooperation with the slot of the impact end of the socket wrench.

2. The tool of claim 1 further including a slot in the socket.

3. The tool of claim 2 wherein the slot is a longitudinal, axial slot in the socket.

4. The tool of claim 1 including a bore in the plate for receipt of a socket drive tool.

5. The tool of claim 2 including a bore in the plate for receipt of a socket drive tool.

6. The tool of claim 3 including a bore in the plate for receipt of a socket drive tool.

7. The tool of claim 1 wherein the wrench impact end includes an arcuate face defined by an edge of the plate for engagement by the drive handle second end.

* * * * *